US005935656A

United States Patent [19]

Koerner et al.

[11] Patent Number: 5,935,656

[45] Date of Patent: Aug. 10, 1999

[54] SHORT DURATION HOT SEAL FOR ANODIZED METAL SURFACES

[75] Inventors: Torsten Koerner, Duesseldorf; Josef Kresse, Rommerskirchen; Wolf-Achim Roland, Solingen; Juergen Lindener, Duesseldorf, all of Germany

[73] Assignee: Henkel Kommanditgesellschaft auf Aktien, Duesseldorf, Germany

[21] Appl. No.: 09/051,856

[22] PCT Filed: Oct. 9, 1996

[86] PCT No.: PCT/EP96/04373

§ 371 Date: Apr. 20, 1998

§ 102(e) Date: Apr. 20, 1998

[87] PCT Pub. No.: WO97/14828

PCT Pub. Date: Apr. 24, 1997

[30] Foreign Application Priority Data

| | | | |
|---|---|---|---|
| Oct. 18, 1995 | [DE] | Germany | 195 38 777 |
| May 31, 1996 | [DE] | Germany | 196 21 819 |

[51] Int. Cl.[6] ..... B05D 7/14

[52] U.S. Cl. ..... 427/384; 148/250; 148/252; 148/272; 148/274; 148/275; 106/14.12; 106/14.13; 106/14.15; 106/14.41; 106/14.42; 106/14.44

[58] Field of Search ..... 427/384; 148/250, 148/252, 272, 274, 275; 106/14.12, 14.13, 14.15, 14.41, 14.42, 14.44

[56] References Cited

U.S. PATENT DOCUMENTS

| | | | |
|---|---|---|---|
| 3,838,023 | 9/1974 | Friedemann et al. | 204/35 N |
| 3,900,370 | 8/1975 | Germscheid et al. | 204/38 A |
| 4,121,980 | 10/1978 | Gohausen et al. | 204/35 N |
| 4,202,706 | 5/1980 | Newell et al. | 148/6.17 |
| 4,376,000 | 3/1983 | Lindert | 148/6.15 R |
| 4,939,001 | 7/1990 | Brodalla et al. | 427/419.2 |
| 5,411,607 | 5/1995 | Basaly et al. | 148/272 |
| 5,478,415 | 12/1995 | Massad et al. | 148/272 |

FOREIGN PATENT DOCUMENTS

| | | |
|---|---|---|
| 1125271 | 6/1996 | China . |
| 0 122 129 | 10/1984 | European Pat. Off. . |
| 0 171 799 | 7/1985 | European Pat. Off. . |
| 2 370 110 | 6/1978 | France . |
| 22 11 553 | 9/1973 | Germany . |
| 2520955 | 9/1976 | Germany . |
| 26 50 989 | 5/1978 | Germany . |
| 38 20 650 | 12/1989 | Germany . |

OTHER PUBLICATIONS

Huang, Diandu Yu Huanbao (1991), 11(1), pp. 15–20. Sealing of anodized aluminum.

Ullmann's Encyclopedia of Industrial Chemistry, 5th ed., vol. 9., 174–176 (1987).

Angew. Chem. Adv. Mater 101(7): 975–977 (1989).

The Surface Treatment and Finishing of Aluminum and its Alloys, 5th ed., ASM International and Finishing Publications Ltd, vol. 2, Chap. 11, 773–856 (1987).

*Primary Examiner*—Erma Cameron

*Attorney, Agent, or Firm*—Ernest G. Szoke; Wayne C. Jaeschke; Norvell E. Wisdom, Jr.

[57] ABSTRACT

A process for sealing anodized metal surfaces is characterized by bringing the anodized metal into contact with an aqueous solution at a temperature from 75° C. to the boiling point of the solution for a time equal to from 0.5 to 2 minutes per micrometer of anodized layer thickness. The solution contains: a) from 0.0001 to 5 g/l of one or more alkali metal and/or alkaline earth metal ions and b) from 0.0005 to 0.5 g/l of one or more organic acids selected from: polycarboxylic acids with from 3 to 6 carboxyl groups; phosphonic acids; and/or polyphosphinocarboxylic acids, the solution containing a greater amount of metal ions of group a) than is needed to insure complete neutralization of the acids of group b).

20 Claims, No Drawings

SHORT DURATION HOT SEAL FOR ANODIZED METAL SURFACES

FIELD OF THE INVENTION

This invention relates to the production of anti-corrosive and/or decorative coatings on metals by means of anodic oxidation. It relates to an improved process for sealing the electrochemically-produced porous anodic coatings in order further to improve the properties thereof.

TECHNICAL BACKGROUND AND RELATED ART

The electrochemical anodic oxidation of metals in suitable electrolytes is a widespread practice for forming anti-corrosive and/or decorative coatings on suitable metals. Such processes are briefly described, for example, on pp. 174–176 of *Ullmann's Encyclopedia of Industrial Chemistry,* 5th Edition, Vol. 9 (1987). According to this reference, titanium, magnesium and aluminum, as well as alloys thereof, may be anodized, the anodizing of aluminum and alloys thereof being the most important from a technical point of view. The electrolytically-produced anodic coatings protect the aluminum surfaces from the effects of weathering and other corrosive media. Anodic coatings are also applied in order to obtain a harder surface and therefore to make the aluminum more wear-resistant. Specialized decorative effects may be achieved by the natural color of the anodic coatings and/or by means of absorptive and/or electrolytic coloring. The aluminum is anodized in an acid electrolyte, sulphuric acid being the most common. Further suitable electrolytes include phosphoric acid, oxalic acid and chromic acid. The properties of the anodic coatings may be varied within wide limits by means of the selection of the electrolyte and the temperature thereof, as well as the current density and the anodizing time. Anodizing usually takes place using direct current or using direct current on which alternating current is superimposed.

The fresh anodic coatings may be subsequently colored by dipping in solutions of a suitable dye or by means of treatment with an alternating current in an electrolyte which contains a metal salt, preferably one which contains tin. As an alternative to subsequent coloring, colored anodic coatings may be obtained by means of so-called "color anodizing processes", which involve anodizing in solutions of organic acids, such as sulfophthalic acid or sulfanilic acid in particular, optionally mixed with sulfuric acid in each case, for example.

These anodically-produced protective coatings, the structure of which has been discussed in scientific papers (R. Kniep, P. Lamparter and S. Steeb: "Structure of Anodic Oxide Coatings on Aluminum", *Angew. Chem. Adv. Mater.* 101 (7), pp. 975–977 (1989)), are often called "oxide coatings". The above-mentioned paper has, however, shown that these coatings are glass-like and contain tetrahedrally-coordinated aluminum. Octahedrally-coordinated aluminum, as in the aluminum oxides, was not found. For the present purposes, therefore, the more general term "anodic coatings" will be used instead of the misleading term "oxide coatings".

However, these coatings do not yet meet all requirements with respect to corrosion protection because they still have a porous structure. This is why it is necessary to densify the anodic coatings. This densification is often undertaken using hot and/or boiling water or steam and is known as "sealing". It closes the pores and thus considerably increases the corrosion protection. There is extensive literature about this sealing process, examples of which are: S. Wernick, R. Pinner and P. G. Sheasby: The Surface Treatment and Finishing of Aluminum and its Alloys", Vol. 2, 5th edition, Chapter 11: "Sealing Anodic Oxide Coatings", (ASM International, Metals Park, Ohio, U.S.A., and Finishing Publications Ltd., Teddington, Middlesex, England, 1987).

When the anodic coatings are sealed, however, not only are the pores sealed, but a more or less thick velvet-like coat is formed on the entire surface, the so-called sealing "smut". This smut, which comprises hydrated aluminum oxide, is visually unattractive, reduces the adhesive strength when such aluminum components are bonded and promotes subsequent contamination and corrosion. As the subsequent removal of this sealing coat by hand using mechanical or chemical means is complex, attempts are made to prevent the formation of this sealing coat by the addition of chemicals to the sealing bath. According to DE-C-26 50 989, additions of cyclic polycarboxylic acids having from 4 to 6 carboxyl groups in the molecule, particularly cyclohexane hexacarboxylic acid, are suitable. According to DE-A-38 20 650 certain phosphonic acids, such as 1-phosphonopropane-1,2,3-tricarboxylic acid, may also be used. The use of other phosphonic acids is known from EP-A-122 129. DE-C-22 11 553 describes a process for sealing anodic oxide coatings on aluminum and aluminum alloys in aqueous solutions containing phosphonic acids or salts thereof and calcium ions, the molar ratio of calcium ions to phosphonic acid being at least 2:1. A higher ratio of calcium ions to phosphonic acid of about 5:1 to about 500:1 is preferably used. Examples of suitable phosphonic acids are: 1-hydroxypropane-, 1-hydroxybutane-, 1-hydroxypentane-, 1-hydroxyhexane-1,1-diphosphonic acid, as well as 1-hydroxy-1-phenylmethane-1,1-diphosphonic acid and preferably 1-hydroxyethane-1,1-diphosphonic acid, 1-aminoethane-, 1-amino-1-phenylmethane-, dimethylaminoethane-, dimethylaminobutane-, diethylaminomethane-, propyl- and butyl-aminomethane-1,1-diphosphonic acid, aminotrimethylene phosphonic acid, ethylene diamine tetramethylene phosphonic acid, diethylene triamine pentamethylene phosphonic acid, aminotri-(2-propylene-2-phosphonic acid), phosphonosuccinic acid, 1-phosphono-1-methylsuccinic acid and 2-phosphonobutane-1,2,4-tricarboxylic acid. It is apparent that this disclosure concerns a conventional heat sealing process using sealing times between 60 and 70 minutes for anodic coating thicknesses between about 18 and about 22 $\mu$m. The sealing time is therefore about three minutes per $\mu$m of coating thickness.

When using water, containing no further additives other than the sealing smut inhibitors mentioned, high temperatures (at least 90° C.) and relatively long treatment times of the order of about one hour have previously been required for effective sealing in the case of an anodic coating of about 20 $\mu$m. This corresponds to a sealing time of about three minutes per micrometer of anodic coating thickness. The sealing process therefore consumes a great deal of energy and may represent a production bottleneck because of its duration. This is why attempts have already been made to find additives for the sealing bath which support the sealing process, so that it may proceed at lower temperatures (so-called "cold sealing") and/or using shorter treatment times. The following have been proposed as additives which permit sealing at temperatures below 90° C., for example: nickel salts, particularly fluorides, which are used in practice to some extent (EP 171 799), nitrosylpentacyanoferrate, complex fluorides of titanium and zirconium, as well as chromates and/or chromic acid, optionally combined with further additives. As an alternative to true sealing, the hydrophobizing of the oxide coating by means of long-chain carboxylic acids or waxes has been recommended, as well as treatment with acrylamides, which should be polymerized in the pores. Further information may be found in the above-mentioned literature reference by S. Wernick et al. Apart from sealing using nickel compounds, these proposals have not been able to gain acceptance in practice.

Processes for cold sealing using nickel fluoride have been introduced on an industrial scale. Complex measures for waste water treatment are, however, required in this case because of the toxic properties of nickel salts.

There is, therefore, still a need for alternative sealing processes for anodized surfaces which enable the production rate to be increased by means of reduced sealing times and/or the energy required for the sealing to be reduced, without using heavy metals, such as nickel, which are questionable from the ecological and health standpoints. An object of the present invention is to provide such a process.

SUMMARY AND DESCRIPTION OF THE INVENTION

The present invention relates to a process for sealing anodized metal surfaces, characterized in that the anodized metal is brought into contact, for between 1 and 2 minutes per micrometer of anodic coating thickness, with an aqueous solution at a temperature between 90° C. and its boiling point and a pH of from 5.5 to 8.5, which contains (a) from 0.1 to 5 g/l total of one or more alkali metal and/or alkaline earth metal ions and (b) from 0.0005 to 0.5 g/l total of one or more organic acids selected from cyclic polycarboxylic acids having from 3 to 6 carboxyl groups and/or phosphonic acids and/or polyphosphino carboxylic acids, the solution containing a larger quantity of the metal ions (a) than is required for the complete neutralization of the acids (b).

The treatment solutions may be brought into contact with the anodized metals by spraying the solutions onto the metal surfaces or preferably by dipping the metal components into the solutions. With a conventional anodic coating thickness of about 20 $\mu$m the required treatment times are only from 20 to 40 minutes. The temperature of the treatment solution is preferably from 94 to 98° C., for example about 96° C.

The pH of the aqueous solution is preferably from 5.5 to 7, particularly from 5.5 to 6.5. The pH may be adjusted using ammonia or acetic acid as required. It may be kept in the required range using ammonium acetate as buffer.

The aqueous solution preferably contains from 0.2 to 2.5 g/l total of metal ions (a). Lithium and magnesium are particularly suitable as metal ions (a). The metals may be used in the form of salts, which are water-soluble in the quoted concentration range, examples being acetate, lactate, sulfate, oxalate and/or nitrate. Acetates are particularly suitable.

In one particular embodiment, the organic acids (b) are selected from saturated, unsaturated or aromatic carbocyclic six-membered-ring carboxylic acids having from 3 to 6 carboxyl groups. Preferred examples of such acids are trimesic acid, trimellitic acid, pyromellitic acid, mellitic acid and the particularly preferred cyclohexane hexacarboxylic acid. The total quantity of the carboxylic acids is preferably from 0.0005 to 0.2 g/l, more preferably from 0.001 to 0.05 g/l.

The prepared cyclohexane hexacarboxylic acid exists in the form of different stereoisomers. As is known from DE-A-26 50 989, those cyclohexane hexacarboxylic acids which have 5-cis and 1-trans or 4-cis and 2-trans carboxyl group(s) are preferred.

In another particular embodiment, the organic acids (b) are selected from the phosphonic acids: 1-phosphonopropane-1,2,3-tricarboxylic acid, 1,1-diphosphonopropane-2,3-dicarboxylic acid, 1-hydroxypropane-1,1-diphosphonic acid, 1-hydroxybutane-1,1-diphosphonic acid, 1-hydroxy-1-phenylmethane-1,1-diphosphonic acid, 1-hydroxy-ethane-1,1-diphosphonic acid, 1-aminoethane-1,1-diphosphonic acid, 1-amino-1-phenyl-methane-1,1-diphosphonic acid, dimethylaminoethane-1,1-diphosphonic acid, propylaminoethane-1,1-diphosphonic acid, butylaminoethane-1,1-diphosphonic acid, amino-tri(methylene phosphonic acid), ethylene diaminotetra(methylene phosphonic acid), diethylene triaminopenta(methylene phosphonic acid), hexamethylene diamino-tetra(methylene phosphonic acid), n-propyliminobis(methylene phosphonic acid), amino-tri(2-propylene-2-phosphonic acid, phosphonosuccinic acid, 1-phosphono-1-methylsuccinic acid and 1-phosphonobutane-1,2,4-tricarboxylic acid. Of this selection, 1-phosphonopropane-1,2,3-tricarboxylic acid, 1,1-diphosphonopropane-2,3-dicarboxylic acid and aminotri (methylene phosphonic acid) are particularly preferred. The phosphonic acids (b) are preferably used in a quantity of from 0.003 to 0.1 g/l.

Particularly good sealing results are obtained if the metal surfaces are dipped in fully deionized water which has a temperature above 90° C., preferably above 96° C., for between 30 and 120 seconds immediately following the short-time heat sealing described above.

In principle, the sealing bath which is suitable for the present sealing process may be made up in situ in the required concentration by dissolving the constituents in water, which is preferably fully deionized. However, in order to prepare the sealing baths, preference is given to an aqueous concentrate which already contains all the requisite constituents of the sealing bath in the correct quantity ratio and from which the ready-to-use solution is obtained by dilution with water by a factor between about 10 and about 100, for example. The pH must be adjusted to the required range, optionally with ammonia or acetic acid. The present invention therefore also relates to an aqueous concentrate for preparing the aqueous solution for use in the present short-time heat sealing process, the concentrate producing the ready-to-use aqueous solution by dilution with water by a factor between about 10 and about 1000.

Sealed anodic coatings which are not inferior to those produced conventionally as regards the coating properties thereof may be produced by the accelerated and energy-saving process according to the present invention. From a technical point of view, the acid erosion in chromic acid, the admittance and the dye spot test in particular are important as test parameters for the coating quality. These quality parameters of the coatings are tested according to standard test methods which are quoted in the examples below.

The sealing process according to the present invention is preferably used for anodized aluminum and/or anodized aluminum alloys. It may, however, also be applied to the anodic coatings of other anodizable metals, such as titanium and magnesium or the respective alloys thereof. It may be used for both uncolorized anodic coatings and those which have been colored according to conventional processes, such as integral coloring, adsorptive dyeing using organic dyes, reactive dyeing with the formation of inorganic dye pigments, electrochemical coloring using metal salts, particularly tin salts, or interference coloring. In the case of adsorptively-dyed anodic coatings, the process according to the present invention has the further advantage that the possible bleeding of the dye which may take place in the case of conventional heat sealing may be reduced by means of the shortened sealing time.

EXAMPLES

Aluminum sheets of the Al 99.5 type were conventionally anodized (direct current/sulfuric acid, one hour, coating thickness 20 $\mu$m) and colored optionally with organic dip dyes or electrochemically. The sheets were then dipped into the comparison solutions and/or sealing solutions according to the present invention as shown in the tables for between 30 and 60 minutes. The solutions had a temperature of 96° C. In addition to the treatment as specified in the tables, the sheets were dipped in boiling, fully deionized water for one minute and then dried. The quality of the sealing was then tested with the quality tests that are common in practice and described below. These results are also quoted in the tables. They show that sealing results which are obtained only after an hour using a conventional heat sealing bath according to the reference example are obtained after as little as 30 minutes using the process according to the present invention. In contrast, the sealing results after half an hour's treatment with the comparison solution are inadequate from a qualitative point of view.

The admittance $Y_{20}$ was determined with a Fischer Anotest Y D 8.1 measuring instrument according to German standard DIN 50949. The measuring system comprises two electrodes, one of which is conductively connected to the basic material of the sample. The second electrode is immersed in an electrolyte cell which may be placed on the coating to be tested. This cell takes the form of a rubber ring with an internal diameter of 13 mm and a thickness of about 5 mm, the annular surface of which is self-adhesive. The measuring surface is 1.33 $cm^2$. A potassium sulfate solution (35 g/l) in fully deionized water is used as the electrolyte. The admittance, which may be read off on the measuring instrument, is converted to a measurement temperature of 25° C. and a coating thickness of 20 $\mu$m as described in DIN 50949. The results obtained, which should preferably be in the range between about 10 and about 20 $\mu$S, are entered in the tables.

As a parameter which shows open-pored and hence poorly sealed coatings, the residual reflection following coloring with dye was measured in accordance with German standard DIN 50946 . To do this, the measuring surface was defined with the aid of a self-adhesive measuring cell from the Anotest apparatus described above. The test surface is wetted with an acid solution (25 ml/l of sulfuric acid, 10 g/l of KF). After exactly one minute, the acid solution is washed off and the test surface dried. The test surface is then wetted with dye solution (5 g/l of Sanodal Blue) which is allowed to act for one minute. The measuring cell is removed after rinsing under running water. The dyed test surface is freed from loosely adhering dye by rubbing with a mild cleaning powder. After the surface has been dried, a relative reflection measurement is taken, by applying the measuring head of a light reflection meter (Micro Color, manufacturer Dr. Lange), first to an undyed part of the surface and then to the dyed measuring surface. The residual reflection is obtained as a percentage by multiplying by one hundred the quotient of the measured value of the dyed surface divided by the measured value of the undyed surface. Residual reflection values between 95 and 100% indicate good sealing quality, while values under 95% are regarded as unacceptable. The higher the values for residual reflection, the higher the sealing quality. The values found are entered in the tables.

The acid erosion was then measured in accordance with ISO 3210. To do this, the test sheet is accurately weighed to within 0.1 mg and then dipped into an acid solution containing 35 ml of 85% phosphoric acid and 20 g of chromium (VI) oxide per liter for 15 minutes at 38° C. At the end of the test period the sample is rinsed with deionized water and dried in a drying cabinet for 15 minutes at 60°C. The sample is then weighed again. The weight difference between the first and the second measurement is calculated and divided by the size of the surface in $dm^2$. The weight loss is expressed as $\Delta G$ in $mg/dm^2$ and should not exceed 30 $mg/dm^2$.

The following concentrates for comparison solutions and treatment solutions according to the present invention were prepared by dissolving the active ingredients in completely deionized water:

Comparison 1: 25 g/l of polyphosphinocarboxylic acid solution (45 wt. % in water) (Acrylic acid/sodium hypophosphite copolymer, BELCLENE® 500, FMC Corporation, Great Britain) 5 g/l of lithium lauryl sulfate (TEXAPON® LLS, Henkel KGaA, Germany)

Example 1: As Comparison 1, plus 1 g/l of lithium acetate

Example 2: As Comparison 1, plus 1 g/l of magnesium acetate

Comparison 2: 25 g/l of BELCLENE® 500

Example 3: As Comparison 2, plus 0.5 g/l of magnesium acetate

Example 4: As Comparison 2, plus 0.2 g/l of magnesium acetate

Comparison 3: 25 g/l of BELCLENE® 500 2.5 g/l of lithium lauryl sulfate

Example 5: As Comparison 3, plus 1 g/l of magnesium acetate

Example 6: As Comparison 3, plus 0.5 g/l of magnesium acetate

Example 7: As Comparison 3, plus 25 g/l of magnesium acetate

For the tests, 2 g of concentrate were made up to 1 liter with completely deionized water. The sheets were then dipped into these working solutions made from Examples 1 to 7 according to the invention and Comparisons 1–3 for 30 minutes.

TABLE 1

TEST RESULTS

| Solution From: | Admittance $Y_{20}$ ($\mu$S) | Residual Reflection (%) | Acid Corrosion Loss (g/100 $cm^2$) |
|---|---|---|---|
| Comparison 1 | 22 | 98 | 23.9 |
| Example 1 | 21 | 100 | 13.1 |
| Example 2 | 22 | 100 | 14.5 |
| Comparison 2 | 27 | 98 | 24.1 |
| Example 3 | 21 | 100 | 13.4 |
| Example 4 | 18 | 100 | 11.8 |
| Comparison 3 | 19 | 98 | 23.5 |
| Example 5 | 19 | 100 | 13.2 |
| Example 6 | 17 | 100 | 12.5 |
| Example 7 | 18 | 100 | 13.0 |

For Comparisons 4 and 5 and Examples 8 to 11 according to the present invention below, the treatment solutions were produced directly in each instance, i.e., without dilution of any corresponding concentrates, by dissolving the materials noted in fully deionized water. The duration of the treatment (immersion) of the test sheets was varied; the times are shown in Table 2.

Comparison 4: 13 ppm of cyclohexane hexacarboxylic acid

Comparison 5: As Comparison 4

Example 8: As Comparison 4, plus 340 ppm of Li (from 5 g/l of lithium acetate dihydrate Example: 9 As Example 8

Example: 10 As Comparison 4, plus 850 ppm of Mg (from 5 g/l of magnesium acetate tetrahydrate Example: 11 As Example 10.

TABLE 2

TEST RESULTS AND TREATMENT TIMES

| Solution According to: | Time, Minutes | Admittance $Y_{20}$, $\mu S$ | Residual Reflection, % | Acid Erosion, $mg/dm^2$ |
|---|---|---|---|---|
| Comparison 4 | 30 | 28 | 93 | 18 |
| Comparison 5 | 60 | 14 | 97 | 12 |
| Example 8 | 30 | 20 | 97.5 | 11 |
| Example 9 | 40 | 14 | 97.5 | 11 |
| Example 10 | 30 | 16 | 97.5 | 11 |
| Example 11 | 40 | 12 | 99 | 10 |

The coatings of reference 1 showed fingermarks. The appearance of the coatings in the other examples was good.

The invention claimed is:

1. A process for sealing an anodized metal surface wherein the anodized metal is contacted for a period of between 0.5 and 2 minutes per micrometer of anodized coating thickness with an aqueous solution which has a temperature of between 75° C. and its boiling point, has a pH of from 5.5 to 8.5, and comprises:

(a) a total of 0.0001 to 5 g/l of one or more metal ions selected from the group consisting of alkali metal and alkaline earth metal ions; and (b) a total of 0.0005 to 0.5 g/l of one or more organic acids selected from the group consisting of cyclic polycarboxylic acids having 3 to 6 carboxyl groups, phosphonic acids, and polyphosphinocarboxylic acids, the aqueous solution containing a larger quantity of the metal ions (a) than is required for complete neutralization of the acids (b).

2. A process according to claim 1, wherein the aqueous solution has a temperature of from 94 to 98° C.

3. A process according to claim 2, wherein the aqueous solution has a pH of from 5.5 to 7.

4. A process according to claim 3, wherein the metal ions (a) are selected from the group consisting of Li and Mg.

5. A process according to one or more of claim 4, wherein the organic acids (b) are selected from the group consisting of saturated, unsaturated, and aromatic carbocyclic six-membered ring carboxylic acids having 3 to 6 carboxyl groups.

6. A process according to claim 5, wherein the aqueous solution contains a total quantity of 0.001 to 0.05 g/l of carboxylic acids selected from the group consisting of trimesic acid, trimellitic acid, pyromellitic acid, mellitic acid and cyclohexane hexacarboxylic acid and 0.2 to 2.5 g/l total of metal ions (a).

7. A process according to claim 4, wherein the organic acids (b) are selected from 1-phosphonopropane-1,2,3-tricarboxylic acid, 1,1-diphosphonopropane-2,3-dicarboxylic acid, 1-hydroxy-propane-1,1-diphosphonic acid, 1-hydroxy-butane-1,1-diphosphonic acid, 1-hydroxy-1-phenylmethane-1,1-diphosphonic acid, 1-hydroxyethane-1,1-diphosphonic acid, 1-amino-ethane-1,1-diphosphonic acid, 1-amino-1-phenylmethane-1,1-diphosphonic acid, dimethylamino -ethane-1,1-diphosphonic acid, propylamino-ethane-1,1-diphosphonic acid, butylamino -ethane-1,1-diphosphonic acid, aminotri(methylene-phosphonic acid), ethylenediaminotetra-(methylene-phosphonic acid), diethylene-triaminopenta(methylene-phosphonic acid), hexamethylene -diaminotetra(methylene-phosphonic acid), n-propyliminobis(methylene-phosphonic acid), aminotri -(2-propylene-2-phosphonic acid), phosphonosuccinic acid, 1-phosphono-1-methylsuccinic acid, 1-phosphono-butane-1,2,4-tricarboxylic acid and polyphosphinocarboxylic acids.

8. A process according to claim 7 wherein the aqueous solution contains the acids (b) in an amount of 0.003 to 0.05 g/l and not more than 0.005 g/l of metal ions (a).

9. A process according to claim 1, wherein the aqueous solution additionally contains 0.001 to 0.05 g/l of non-ionic or anionic surfactants.

10. A process for sealing anodized metal surfaces, wherein after completion of a process according to claim 1, the metal surfaces are immersed for a period of between 30 and 120 seconds in completely deionized water, which is at a temperature of above 90° C.

11. An aqueous concentrate which, by dilution with water by a factor of between 10 and 1000 and, optionally, addition of acetic acid or ammonia, produces an aqueous solution that has a pH of from 5.5 to 8.5 and comprises:

(a) a total of 0.0001 to 5 g/l of one or more metal ions selected from the group consisting of alkali metal and alkaline earth metal ions; and a total of 0.0005 to 0.5 g/l of one or more organic acids selected from the group consisting of cyclic polycarboxylic acids having 3 to 6 carboxyl groups, phosphonic acids, and polyphosphinocarboxylic acids, and contains a larger quantity of the metal ions (a) than is required for complete neutralization of the acids (b).

12. A process according to claim 1, wherein the aqueous solution has a pH of from 5.5 to 7.

13. A process according to claim 2, wherein the metal ions (a) are selected from Li and Mg.

14. A process according to claim 1, wherein the metal ions (a) are selected from Li and Mg.

15. A process according to claim 1, wherein the organic acids (b) are selected from the group consisting of saturated, unsaturated or aromatic carbocyclic six-membered ring carboxylic acids having 3 to 6 carboxyl groups.

16. A process according to claim 15, wherein the aqueous solution contains the carboxylic acids in a total quantity of 0.001 to 0.05 g/l.

17. A process according to claim 16, wherein the aqueous solution contains 0.2 to 2.5 g/l total of metal ions (a).

18. A process according to claim 1, wherein the organic acids (b) are selected from the group consisting of 1-phosphonopropane-1,2,3-tricarboxylic acid, 1,1-diphosphonopropane-2,3-dicarboxylic acid, 1-hydroxy-propane-1,1-diphosphonic acid, 1-hydroxy-butane-1,1-diphosphonic acid, 1-hydroxy-1-phenylmethane-1,1-diphosphonic acid, 1-hydroxyethane-1,1-diphosphonic acid, 1-amino-ethane -1,1-diphosphonic acid, 1-amino-1-phenylmethane-1,1-diphosphonic acid, dimethylamino-ethane-1,1-diphosphonic acid, propylamino-ethane-1,1-diphosphonic acid, butylamino-ethane-1,1-diphosphonic acid, aminotri(methylene-phosphonic acid), ethylenediaminotetra(methylene-phosphonic acid), diethylene-triaminopenta(methylene-phosphonic acid), hexamethylene-diaminotetra(methylene-phosphonic acid), n-propyliminobis(methylene-phosphonic acid), aminotri-(2-propylene-2-phosphonic acid), phosphonosuccinic acid, 1-phosphono-1-methylsuccinic acid, 1-phosphono -butane-1,2,4-tricarboxylic acid and polyphosphinocarboxylic acids.

19. A process according to claim 18, wherein the aqueous solution contains the acids (b) in an amount of 0.003 to 0.05 g/l.

20. A process according to claim 19, wherein the aqueous solution contains not more than 0.005 g/l total of metal ions (a).

* * * * *